US005540608A

United States Patent [19]

Goldfarb

[11] Patent Number: 5,540,608

[45] Date of Patent: Jul. 30, 1996

[54] PLAY DEVICES FOR PLAYING MUSICAL TUNES WHEN REPEATEDLY ACTUATED

[76] Inventor: Adolph E. Goldfarb, 1432 S. Eastwind Cir., Westlake Village, Calif. 91361

[21] Appl. No.: 379,255

[22] Filed: Jan. 27, 1995

[51] Int. Cl.[6] ..... A63H 33/28; A63H 5/00

[52] U.S. Cl. ..... 446/15; 446/408; 446/484; 84/600

[58] Field of Search ..... 446/15, 19, 484, 446/397, 408; 84/600, 609

[56] References Cited

U.S. PATENT DOCUMENTS

| | | | |
|---|---|---|---|
| 3,123,936 | 3/1964 | Feltman | 446/15 |
| 4,282,681 | 8/1981 | McCaslin | 446/484 |
| 4,981,457 | 1/1991 | Iimura et al. | 446/408 |
| 5,135,426 | 8/1992 | Lin | 446/408 |

*Primary Examiner*—Mickey Yu
*Attorney, Agent, or Firm*—Ashen, Golant & Lippman

[57] ABSTRACT

A toy for interacting with a series of bubbles to play a tune. The illustrated toy has a housing that includes a handle and at least two spaced-apart electrical contacts. Housed within the housing and electrically connected to the contacts and to one another in a circuit are a microprocessor chip, a speaker and a holder for a power source such as a battery. Each time the contacts strike a bubble, the circuit is completed, which causes a note to be emitted from the speaker. The microprocessor is programmed so that when the contacts sequentially engage a plurality of bubbles, a series of notes are emitted that create a tune. The illustrated toy also includes a blower mechanism for producing a plurality of bubbles for use with the toy.

18 Claims, 3 Drawing Sheets

PLAY DEVICES FOR PLAYING MUSICAL TUNES WHEN REPEATEDLY ACTUATED

BACKGROUND OF INVENTION

Toy devices which play music are many and varied in the prior art. There have been a variety of simple mechanical devices. In more recent times there have been devices which utilize microprocessor chips to produce songs in children's toys. Such devices are typically just turned on or caused to produce the desired music. While they are entertaining for the music provided, few provide additional or supplemental play value.

There is a device marketed by Tiger Electronics, Inc. that is sold under the trademark "BUBBLE BOPPER" which is essentially an elongated toy wand. At one end of the wand there is a ring which can be dipped in a soap solution for blowing bubbles. At the other end is an electrical contact arrangement for engaging the bubbles and thereby producing one of a plurality of different sounds. These sounds are represented in the manufacturer's literature as "ping," "ting-a-ling," "twinkle," "boom", "pow" and "crash." These sounds do not combine to play a musical tune. In fact, there is no relationship between the sounds, each sound being separate and distinct.

SUMMARY OF THE DISCLOSURE

The illustrated toy interacts with a series of bubbles to play a tune. The illustrated toy comprises a housing that has a handle portion and at least two spaced-apart electrical contacts. Housed within the housing and electrically connected to the contacts and to one another to form a circuit are means for supporting a source of power such as an electric battery, a speaker, and a microprocessor chip, and several other electrical components. When a bubble engages the contacts, the circuit is completed and the power source causes the microprocessor to drive the speaker to emit a predetermined note in a predetermined series of notes. A series of bubbles engaging the contacts results in that series of notes, that combine to provide a tune. The illustrated toy also includes a bubble blower in the housing for producing a plurality of bubbles for use with the toy.

IN THE DRAWINGS

DETAILED DESCRIPTION OF THE DRAWINGS

Figures 1, 2, 3:
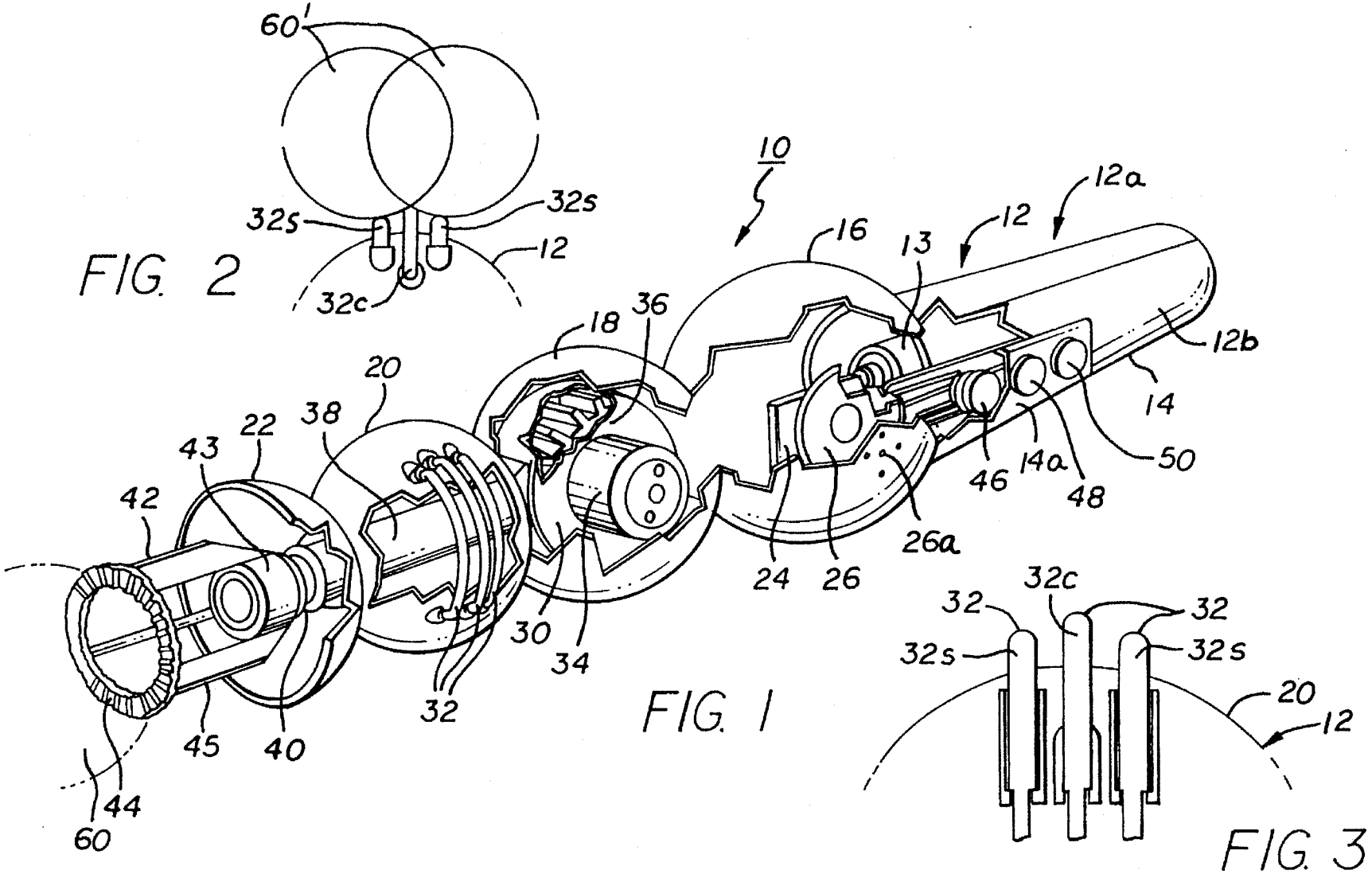
FIG. 1 is a perspective view (with portions broken away) of a toy device embodying a presently preferred form of the invention.
FIG. 2 is a schematic view showing the electrical contacts of the toy of FIG. 1 as they would engage several bubbles.
FIG. 3 is an enlarged schematic view of the contacts and the adjacent housing portion.

The illustrated music making toy 10 comprises an elongated frame or housing 12. The illustrated housing 12 may conveniently be made up of two half sections 12*a*, 12*b* of molded plastic or the like secured together to contain the various internal components. As viewed externally, the housing 12 comprises an elongated rear handle portion 14 at one end, a series of three bulbous intermediate portions 16, 18, 20, and a front end portion 22 from which blown bubbles 60 are emitted.

In general, housed within the housing 12 are the major components of the toy, i.e., a microprocessor chip and other electrical components 24, a speaker 26, means (not shown) for supporting a power source such as one or more dry cell batteries B, and a bubble-blowing mechanism 30.

Figure 4:
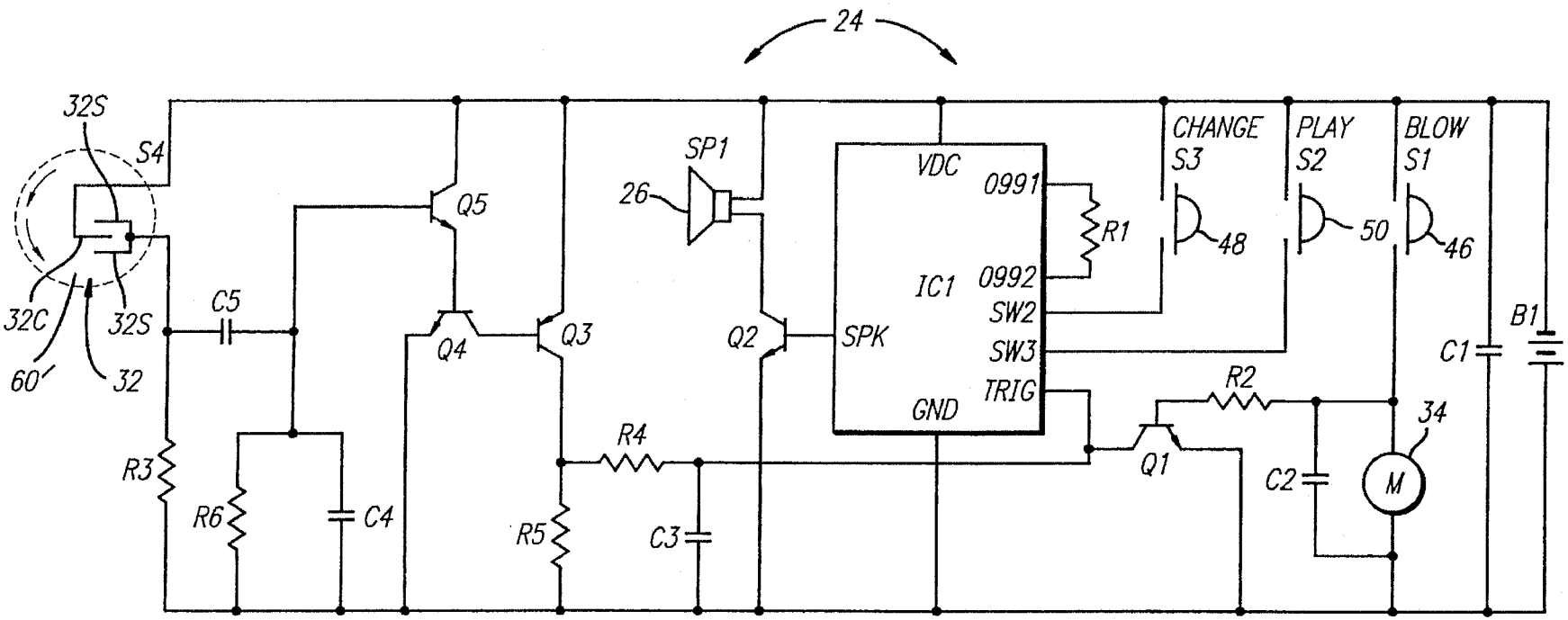
FIG. 4 is a schematic wiring diagram of the circuitry incorporated within the toy device of FIGS. 1–3.

At the intermediate portion 20 closest to the bubble emitting front end, there are mounted externally of the housing three arcuate spaced-apart electrodes or electrical contact rails 32 to serve as trigger wires. These preferably comprise a central contact rail 32*c* and two side contract rails 32*s* connected as shown at the left of FIG. 4. The contact rails 32 are electrically connected to the electrical components and the battery supports so as to form a circuit (not shown) that is completed when a bubble engages any two adjacent contact rails 32 and, in effect, closes a switch by providing a path for electrical flow between such contact rails. When this happens, a pulse is passed to the trigger pin of the microprocessor that sends an appropriate signal to the speaker 26 to emit a predetermined note. When the contact rails 32 sequentially engage a plurality of bubbles, the microprocessor produces a predetermined series of notes that combine to create a tune.

More particularly, the speaker 26 is housed in the first bulbous portion 16 adjacent to the handle portion 14. Suitable speaker holes 26*a* are provided in the housing so that the sound from the speaker can be readily heard by the child user. The microprocessor chip and associated components 24 are electrically connected to the speaker 26 and are mounted within the same housing portion 16 and the handle portion 14. The microprocessor chip and components 24 are also electrically connected to the contact rails or trigger wires 32.

Also mounted on the handle portion 14 is a control panel 14*a* that has three control buttons 46, 48 and 50, whose functions will be described below.

The bubble blowing mechanism 30 includes a suitable electric motor 34 and a rotary turbine-type blower 36 that is driven by the motor. The motor 34 and the blower 36 are mounted generally coaxially within housing portion 18. Suitable inlet openings (not shown) are provided in the housing wall adjacent to the blower 36. The blower mechanism 30 also includes an elongated blower tube 38 that extends forwardly from the blower 36 through housing portion 20 and opens at its front end 40 at the front end of the toy within housing portion 22. Mounted on the blower tube front end 40 is an open support structure 42 that holds a circular open bubble-blowing ring 44 spaced in front of the blower tube front end 40. The support structure 42 includes an open mounting hub 43 that fits over the blower tube front end 40. The support structure 42 also includes three circumferentially spaced-apart longitudinal sections 45 that connect the ring 44 to the hub 43. The ring 44 may be dipped in a soap solution to create a film across it. Then when air is blown by the blower 36 through the tube 38 against the film across the ring 44 a series or plurality of bubbles 60 are produced.

The electric motor 34 is connected by suitable electrical leads (FIG. 4) to the batteries B and through to an on/off "BLOW" switch S1. That switch S1 is operated by a control button 46 located on the handle portion 14 and externally accessible by the user.

Particular attention is directed to the construction of the arcuate contact rails or trigger wires 32. In the illustrated device 10, there are three of these wires 32 that extend partially circumferentially around the forward most bulbous housing portion 20. These wires 32 lie in planes that are generally perpendicular to the longitudinal axis of the housing 12. The wires 32 extend generally parallel to one another, with spaces between adjacent wires. It has been found that wires of approximately 0.1 of an inch in diameter spaced-apart by approximately 0.1 of an inch operate affectively for the desired purpose of engaging airborne bubbles and having a circuit completed when a bubble makes contact across either adjacent pair of the rails or wires 32.

Various other controls may be provided for operating the device 10. In the illustrated device 10 there is a control button 48 for operating a "CHANGE" switch 53 (FIG. 4) to select among different tunes, and a control button 50 for operating a "PLAY" switch S2 to preview the currently selected tune by playing that tune.

Figure 5:
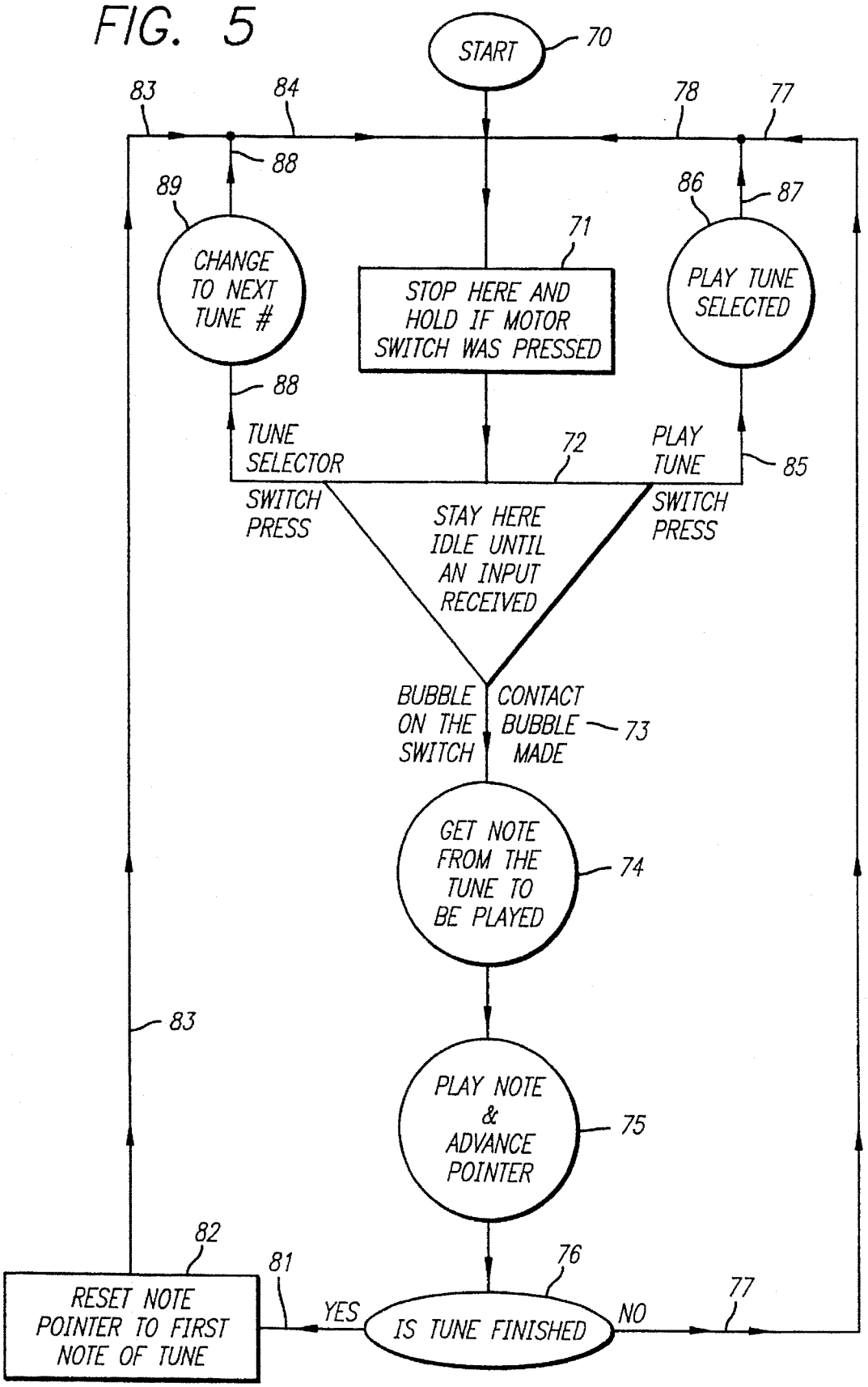
FIG. 5 is a flow diagram illustrating the operation of the toy device of FIGS. 1–3.

FIGS. 4 and 5 are wiring and flow diagrams, respectively, that show in detail the circuitry and operation of the device 10.

The contact rails 32 are connected to a probe stage C3-C5, Q3-Q5, R3-R5 that constantly monitors for the presence of bubbles. Upon detecting a bubble 60' the probe circuit passes a high-state signal to the TRIG ("trigger") input terminal of the microprocessor chip IC1, which in turn provides acoustic-frequency signals through its SPK ("speaker") output terminal and an amplifier Q2 to the speaker 26/SP1.

The probe stage and the rest of the toy work together as follows. The center contact rail 32*c* is connected to the positive side of the power supply B1, and the two side contact rails 32*s* are connected through an a.c. coupling capacitor C5 to the base of a sensing transistor Q5. The voltage pulse from coupler C5 is then filtered by capacitor C4 and R6 to form a high frequency filter to remove spikes and passes A voltage of a suitable level from their junction to the base of the probe Q5 for flow of rated control current into the base to turn on the probe Q5.

When the circuit 24 is quiescent and none of the switches S1–S4 is closed, a resistor R3 holds low the two side contacts 32*s* and the coupling capacitor C5. Another resistor R6 holds low the base of the sensing transistor Q5.

Two other resistors R4, R5 in series hold low the TRIG terminal of the processor chip IC1, thereby acting through the firmware in the chip to inhibit generation of acoustic-frequency signals for the speaker 26.

To start the processes of the toy, a user first operates the "BLOW" button 46 to close the associated switch S1 and start the bubble-blowing motor 34; bubbles 60 (FIGS. 1 and 2) now become available for use by the probe stage to activate the music circuit.

The user next holds or bodily moves the toy so as to touch either adjacent pair of the contact rails 32 to a particular bubble 60'. The moisture in the bubble provides between the contact rails 32 a connection that is of relatively high impedance, but reproducible in neither impedance nor duration.

This connection draws up the top end of the resistor R3 momentarily, sending a bidirectional pulse (first positive-going, then negative-going when the connection later fails) through the coupler C5 to the base of the sensing transistor Q5. The voltage in the pulse is divided by the coupler C5 and another series capacitor C4, to apply voltage of a suitable level from their junction to the base of the probe Q5 for flow of rated control current into the base to turn on the probe Q5.

It will be understood that the erratic character of a connection provided by a soap bubble 60' produces a ragged waveform, at the top of the first resistor R3, that is not conducive to reliable and stable control of the processor chip IC1. Accordingly it is desirable to select capacitance and resistance values for the elements R3, R6, C5, C4 to provide an insensitivity to such erratic bubble characteristics.

It is also desirable to select these same values to provide suitable time constants for operation of the probe Q5 for an interval that is appropriate to actuate the later stages independently of the bubble-contact duration—and then turn off the probe transistor Q5 after the later stages have had time to react as desired. These criteria have been incorporated into the component values tabulated later in this documents.

Therefore these resistors R3, R6 and capacitors C4, C5 form a coupling network that shapes the positive-going side of the pulse applied to the probe Q5 with respect to both voltage and duration. They essentially ignore its negative-going side.

Actuation of the probe transistor Q5 directs current into the base of a base-follower buffer stage Q4, and a resulting lower-impedance signal current is applied to a switch transistor Q3. The latter generates a pulse that raises the trigger terminal TRIG of the processor IC1.

An R-C filter R4,C3 controls the length of the trigger pulse to suit the requirements of the circuit,within the chip IC1, that is controlled by the trigger terminal TRIG. This filter R4, C3 also ensures that the length of the trigger pulse accommodates the requirements of the responding firmware in the chip IC1.

FIG. 4 shows that a single power supply such as a pair of dry cells B1 powers both the bubble-blowing motor 34/M (through the "BLOW" switch S1) and the speaker 26, as well as the electronics section 24 of the circuit—including the integrated-circuit digital processor chip IC1. This dual usage of the power supply B1 is a significant feature from a practical-economics point of view, and is facilitated by several circuit details:

- A capacitor C1 across the battery helps start the motor 34 when the "BLOW" switch S1 is closed, and also tends to protect the electronics section—and particularly the chip IC1—from voltage spikes generated in starting and stopping of the motor 34.
- An interlock circuit R1-Q1 disables the music-generating functions during bubble-blowing, so that the power supply B1 need not power the speaker 26/SP1 and chip IC1 while powering the motor 34.
- A second capacitor across the motor 34 further suppresses motor-generated spikes and in particular minimizes their application through the interlock resistor R2 to the interlock transistor Q1 and the processor IC1—and associated sensitive components such as Q3.

Operation of the interlock R2-Q1 begins when a user actuates the "BLOW" button 46: closure of the associated switch S1 directs actuating current not only to the motor 34 but also through the resistor R2 into the base of a bypass transistor switch Q1, turning on that switch and locking the TRIG terminal low. In this condition the bypass switch Q1 drains any trigger-actuation pulse from the switch Q3 to the low side of the circuit, suppressing operation of the music chip IC1.

A resistor R1, connected between two timer terminals of the processor IC1 controls the timing functions of the microprocessor and controls the duration of each note or tone that is played in the bubble-operated mode of the toy. Preferred components for the illustrated system are:

| | | | | | |
|---|---|---|---|---|---|
| C1 | 220 μF | R1 | 180 kΩ | Q1 | NPN |
| C2 | 47 μF | R1 | 10 kΩ | Q2 | NPN |
| C3 | 0.01 μf | R3 | 15 mΩ | Q3 | PNP |
| C4 | 20 pF | R4 | 1 kΩ | Q4 | NPN |
| C5 | 100 μF | R5 | 100 kΩ | Q5 | NPN |
| | | R6 | 15 MΩ | | |
| | IC1 | | multitune music chip | | |
| | B1 | | two AA-size batteries | | |
| | S1–S3 | | push button switches. | | |

The chip IC1 is one that can be used in more conventional systems simply to play tunes continuously from beginning to end, and in fact is so used in the present system to preview an entire tune or just to play a tune for enjoyment if that is what the user wishes. This occurs if the user presses the "PLAY" button 50, actuating the associated switch S2 of the circuit, to draw the "S3" terminal of the chip IC1 high.

Such a chip with conventional tune-playing firmware typically has a tabulation of frequency and duration for each tone to be generated in playing of each tune, and a note pointer that moves through the table selecting each entry in turn. The information found from each entry proceeds to a conventional tone-generating firmware module which, responds by generating notes of the various specified frequencies and holding those notes and correspondingly various specified time.

Ordinarily (and in the full-length play mode mentioned above) the note pointer operates continuously through the table from beginning to end. For purposes of the present invention the chip IC1 must be a type that has the capability to sound just one tone and then stop to wait for an instruction to play the next.

The chip IC1 preferably holds several tunes, selectable in rotating sequence by operating of the "CHANGE" button 48 to close the associated switch S3 of the circuit and draw high the "SW2" terminal of the chip.

Logic flow in the system starts with power-up 70 (FIG. 5), which may occur when batteries are inserted into the toy or if preferred when an optional power switch (not shown) is closed. The apparatus automatically selects a particular tune and positions the note pointer at the first note of that tune.

The system proceeds to a "stop and hold" block 71, responsive to operation of the "BLOW" button 46, this function preferably is implemented in hardware by the music-suppressing interlock R2-Q1 as described earlier.

The next logical point is an "idle" function in which the chip IC1 waits for an instruction. If an instruction arrives in the form of a trigger pulse 73 from the bubble-detection circuit detailed above, the apparatus automatically reads 74 a note frequency and duration form the tone table—at the current position of the note pointer—and then sounds 75 the specified note and advances the note pointer.

Next the system tests 76 whether the pointer has reached the end of the tune. If not, logic flow proceeds along an inner-loop reset path 77, 78 to reenter the idle point 72 where it waits for the next instruction.

If the test 76 reveals that the note pointer has 81 reached the end of the tune, the chip IC1 resets 82 its own note pointer to the beginning of the tune and proceeds along an outer-loop reset path 83, 84 to reenter the idle point 72 and wait for the next instruction.

While the system is at the idle point 72, if an instruction arrives in the form of a "PLAY" switch S2 closure, the logic flow proceeds at 85 to play 86 the selected tune from beginning to end—preferably by resetting the tone pointer the beginning of the tune and operating it through the note table in the conventional continuous manner mentioned previously. If preferred, however, the device can be programmed so that the tone pointer picks up where it is, rather than resets, so that if the system has been in use in the bubble-responsive mode the tune will resume just after the last bubble-actuated note. In either event the logic flow then proceeds as along a reset path 87, 78 to the idle point 72.

When the firmware flow is at the idle node 72, if instead an instruction arrives in the form if a "CHANGE" switch S3 closure, the chip IC1 automatically takes a different flow path 88 that includes responding by selection 89 of another tune and setting the tone pointer to the first note of that tune. This path 88 continues along a reset path 84 to the idle node 72. Various modifications may be made in the specific structure illustrated without departing from the spirit and scope of the present invention as set forth in the following claims.

What is claimed is:

1. A method for creating a tune using a toy apparatus that has preprogrammed electronics and a speaker that will play sequential notes in a series that combine to form a tune, the electronics and speaker being actuated to play one of the notes each time contact is completed across a pair of spaced-apart rails, a) blowing a plurality of bubbles, b) sequentially engaging the bubbles one at a time with the spaced-apart rails so as to repeatedly complete the circuit and thereby play the notes of the tune.

2. A toy for interacting with a series of bubbles to play a tune, said toy comprising:

a) a frame including a handle portion, b) a bubble blowing mechanism mounted on the frame for producing a plurality of bubbles, c) at least two spaced-apart electrical contact rails mounted on the frame, d) a speaker mounted on the frame, e) electronics, including a microprocessor chip, mounted on the frame, which when actuated send an electrical signal to the speaker, f) means on the frame for supporting a power source, g) means on the frame electrically connecting in a circuit the power source support means, the electronics, the speaker, and the contact rails so that when a power source is in the support means and a bubble engages and thereby electrically connects two of said contact rails to one another, the circuit is completed and the electronics are activated to send an electrical signal to the speaker, the electronics being programmed to produce, when repeatedly actuated, a predetermined series of electrical signals, each of said signals causing the speaker to deliver a predetermined note, the signals combining to produce a predetermined series of notes that comprise a predetermined tune.

3. The toy of claim 2 wherein said bubble blowing mechanism includes a ring structure at one end of said elongated frame.

4. The toy of claim 3 wherein said bubble blowing mechanism includes a blower arranged to direct a flow of air through the ring structure, a motor connected to the blower for actuating the blower, and electrical circuitry connecting the motor to the power support means.

5. The toy of claim 4 further including an on/off switch for controlling the operation of the motor.

6. The toy of claim 2 wherein said frame is an enclosed housing containing said speaker, said electronics and said power support means.

7. The toy of claim 6 where said housing also contains said bubble blower, a motor for driving the blower, and means for selectively providing power to the motor.

8. The toy of claim 2 wherein said contact rails are each an elongated section with said sections being disposed generally parallel to one another.

9. The toy of claim 8 wherein said contact rails are in the form of generally curved arcs.

10. The toy of claim 2 wherein there are three spaced-apart contact rails.

11. The toy of claim 2 wherein the bubble blowing mechanism produces bubbles at one end of the frame and there is a elongated handle at the other end of the frame.

12. The toy of claim 2 wherein the electronics are capable of selectively playing at least two different predetermined tunes.

13. The toy of claim 1 wherein the electronics are programmed to play a prearranged series of different tunes.

14. The toy of claim 12 further including means to select between said different tunes.

15. The toy of claim 14 further including means to preview the play of a selected tune.

16. The toy of claim 4 wherein said electronics are designed and arranged so that no notes are produced while the motor is energized.

17. The toy of claim 16 wherein said electronics and said motor are designed and arranged so that the power available from the battery is larger than the power requirement of the motor alone and of the electronics and speaker alone, but substantially lower than the combined power requirement of both (1) the motor, and (2) the electronics and the speaker together.

18. The toy of claim 8 wherein said contact rails are spaced approximately 0.1 of an inch from one another.

* * * * *